United States Patent [19]

Salacuse

[11] Patent Number: 4,712,671

[45] Date of Patent: Dec. 15, 1987

[54] UNIVERSAL HANGING PACKAGING SYSTEM

[76] Inventor: Frank S. Salacuse, 710 Park Ave., New York, N.Y. 10021

[21] Appl. No.: 867,829

[22] Filed: May 27, 1986

[51] Int. Cl.[4] ..... B65D 5/50

[52] U.S. Cl. ..... 206/44 R; 206/806; 220/212; 220/85 P

[58] Field of Search ..... 206/806, 44 R; 220/212, 220/306, 85 P; 248/359, 360, 318

[56] References Cited

U.S. PATENT DOCUMENTS

| | | | |
|---|---|---|---|
| 3,240,384 | 3/1966 | Lermer | 206/806 |
| 4,020,947 | 5/1977 | Roccaforte | 206/806 |
| 4,140,218 | 2/1979 | Forte | 206/806 |
| 4,258,857 | 7/1981 | McGee | 206/806 |

*Primary Examiner*—Joseph Man-Fu Moy

*Attorney, Agent, or Firm*—Paul J. Sutton

[57] ABSTRACT

A system for hanging a packaged product such as a container having a flat-topped plastic cap from a rod at a display rack. A plastic tab is integrally mounted to the flat top of the cap. The tab is movable between nonoperative and operative positions, wherein in the nonoperative position the tab lies flat against the top of the cap, and in the operative position the cap is rotated to a position perpendicular to the top of the cap. The tab includes a loop portion forming a hole and a hinge portion that is integrally and flexibly connected to the loop portion and to the cap. The top of the cap forms a recess that is adapted to snugly receive the tab. The hole is adapted to receive the rod of the display rack so as to support the container. The tab and the hole can have various configurations. Two tabs are provided for large caps.

10 Claims, 6 Drawing Figures

FIG. 3
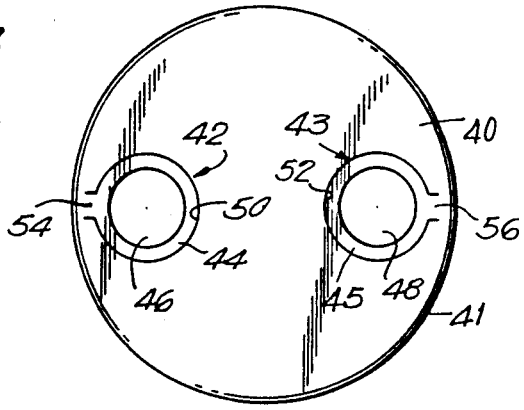
FIG. 4
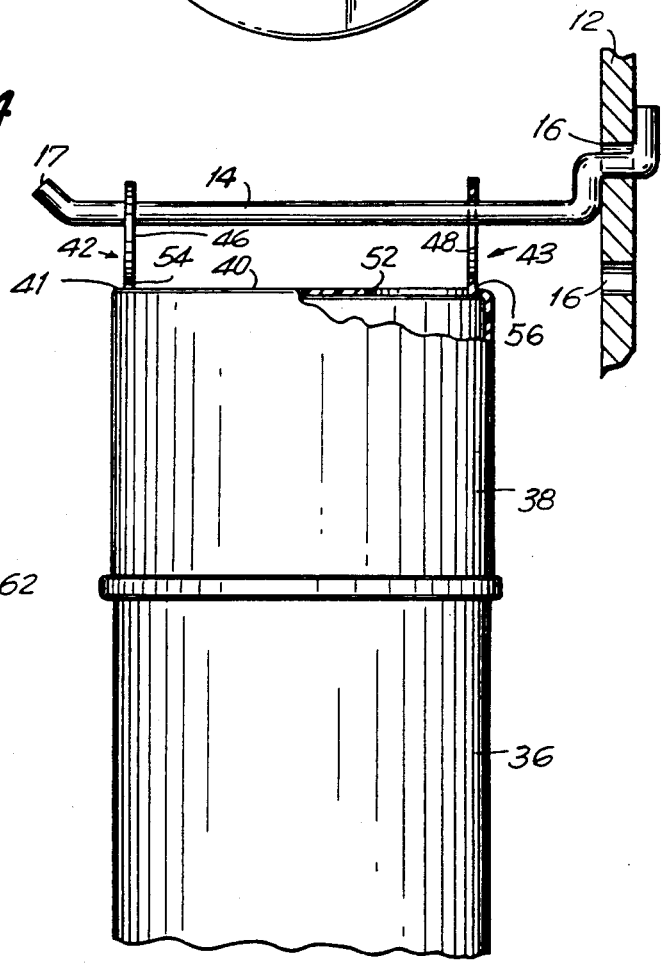
FIG. 5
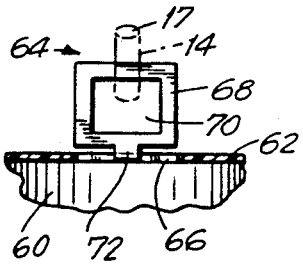
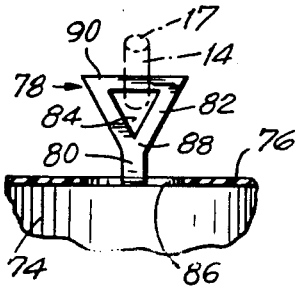
FIG. 6

UNIVERSAL HANGING PACKAGING SYSTEM

FIELD OF THE INVENTION

This invention relates to a tab device integrally molded with a packaged product adapted to be efficiently packed for shipping and also to be hung from a mounting rod of any merchandise display by the tab.

BACKGROUND OF THE INVENTION

Merchandise hung from display racks has certain retailing advantages over products on shelves, as is known in the sales field. Products hung from display racks have generally been lightweight items, typically packaged in plastic or cardboard with a plastic or cardboard extension having a hole adapted to be received by one of the mounting rods that extend horizontally from the display rack or peg board. Widely sold but relatively heavy products that are packaged in plastic or metal containers, such as liquid spray-ons of various types, are placed on shelves rather than hung from display racks since projections are not present for forming holes that would accept a mounting rod. Such projections would not only be relatively expensive to make but would also make the product difficult to package for shipping. It is also apparent that to separately package the product so as to adapt the product to be hung from a merchandise display would add considerably to the cost of the product. A retailing advantage is thus unable to be used by the sellers of such products.

SUMMARY OF THE INVENTION

It is an object of the present invention to provide a universally adaptable hinged tab that is integrally molded with the outer surface of a packaged product that can be easily packaged and shipped and subsequently hung by the tab from the mounting rod of any merchandise display rack.

It is another object of the present invention to provide at least one mounting tab with the snap-on plastic cap of a container that can be both conveniently packed and subsequently hung from any merchandise display rack.

It is another object of the present invention to provide an inexpensive, convenient tab having a living, or flexible, hinge integral with a plastic portion of a container containing a product for sale, the tab having a hole adapted to be received by the rod of any merchandise display rack after the tab has been rotated from its packing position to a display position.

In accordance with the above objects and others that will become apparent in the discussion that follows, a system is set forth for hanging a packaged product at a display rack having at least one horizontal mounting rod extending horizontally from the rack, the rod having a free end spaced from the rack. The system comprises a container having a plastic portion having a surface; and a tab integral with the plastic portion adapted to mount the container with the rod. The tab is movable between a nonoperative position wherein the tab is positioned along the surface and an inoperative position wherein the tab has been rotated away from the surface. The plastic portion is preferably a snap-mounted, or snap-on, cylindrical plastic cap or a screw on plastic cap, the cap having a flat top. The flat top is the surface mentioned above. The tab is flat having a loop portion and a hinge portion. The loop portion includes a continuous wall defining a hole that is adapted to be received by the rod of the display rack when the tab is in the operative position. A recess formed at the flat top of the cap is adapted to receive the tab in a snug fit when the tab is in its nonoperative position, with the tab being parallel and flush with the flat top of the cap. The loop portion of the tab can be configured variously as a semicircle, a circle, a square, or a triangle. The hole formed by the loop portion is preferably the same as the general configuration mentioned of the loop portion. When the cap is relatively small, one tab is integrated with the top of the cap; and when the cap is relatively large, a pair of spaced tabs that have aligned holes when the tabs are in the operative position are provided. The hinge between the cap and the tab is preferably a narrow strip. The hinge is a flexible, living-type hinge that keeps the shape to which it is placed, whether in the nonoperative or operative positions.

My description will be more clearly understood from the following description of a specific embodiment of the invention together with the accompanying drawings in which:

FIG. 3 shows in plan view of a relatively large snap-on plastic cap having a pair of integral tabs formed as circular loops;

FIG. 4 is a fragmented side view of the container and loops shown in FIG. 3 with the tab raised in operative position and hung from a mounting rod of a display rack;

FIG. 5 is a frontal view of a tab having a square loop that is raised in operative position; and FIG. 6 is a frontal view of a tab having a triangular loop that is raised in operative position.

DETAILED DISCUSSION OF THE PREFERRED EMBODIMENTS

Reference is now made in detail to the drawings, in which the same numerals refer to the same or similar elements throughout.

Figure 1:
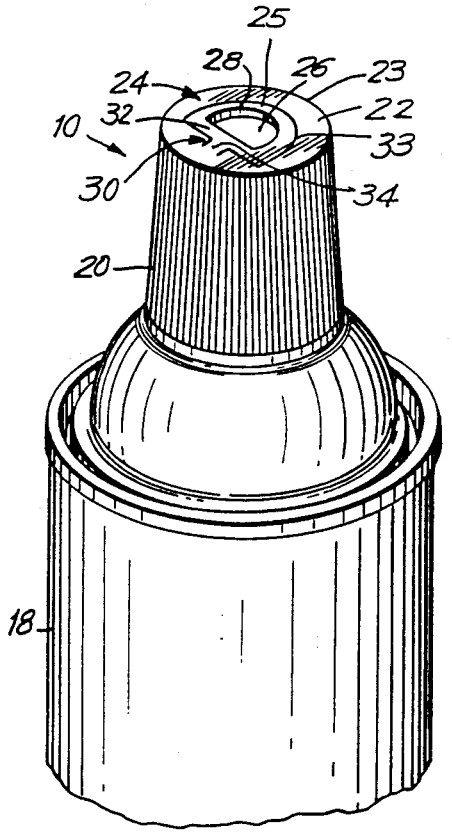
FIG. 1 is a perspective view of the upper portion of a container holding a product that also has a plastic snap-on cap with a tab formed as a semi-circular loop integrally flush-mounted with the top of the cap.
Figure 2:
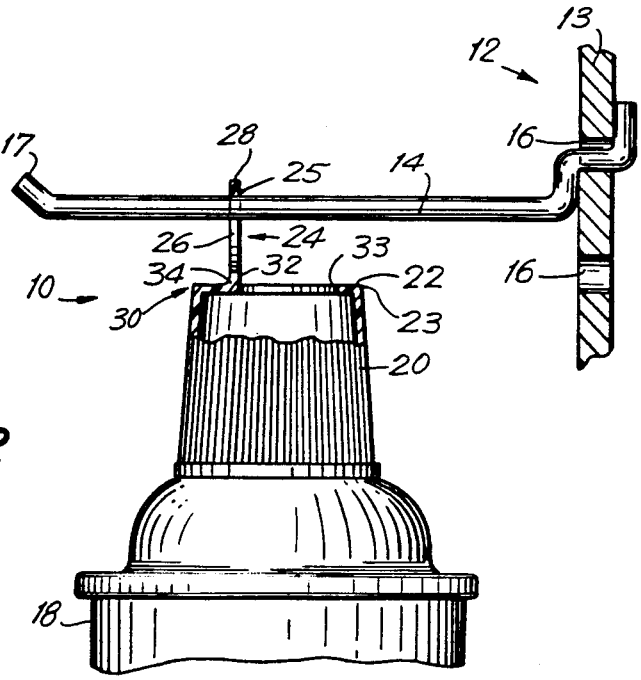
FIG. 2 is a fragmented side view of the container, the snap-on cap, and the tab rotated at the flexible hinge so that the tab has been rotated to a generally vertical, that is, perpendicular, position relative to the top wall of the cap shown in FIG. 1.

A mounting device 10 for hanging a product at a merchandise display rack 12, here shown as including a peg board 13 for purposes of exposition, is shown in its nonoperative position in FIG. 1 and in its operative position in FIG. 2. Display rack 12 also includes a horizontally extending mounting rod 14 having a locked, stepped end secured through one hole 16 of a number of holes in peg board 13 and an opposed free end 17 spaced from peg board 13. A cylindrical container 18, which holds a compressed gas or liquid, and which can be made of either metal or plastic, is illustrated. The applicator (not shown) at the top of container 13 is protected by a plastic, cylindrical, snap-on type cap 20 having a flat top surface 22 with a circular edge 23. The diameter of cap 20 is relatively small as compared to the diameter of container 18. When a user is ready to use container 18, cap 20 is removed by finger-pressing it off. When the user has finished using the container, cap 22 is snap-mounted back onto the top of container 18. The snap-on mounting is known in the art.

Cap 20 includes a tab 24 that is flat in side view as seen in FIG. 2. Tab 24 includes a flat loop portion 25, which in turn includes a narrow continuous element, or wall, 28 that is configured as a semicircle in a frontal view forming a semicircular hole 26 as indicated in FIG. 1, hole 26 being adapted to receive rod 14 as shown in FIG. 2. Cap 22 also includes a living, or flexible, hinge 30 shown integral with loop portion 25 at the center of the base wall 32, which is a part of semicircular continuous wall 28. Hinge 30 is also integral with cap 22. Tab 24 occupies the major portion flat top 22; and hinge 30 is proximate to circular edge 23. Flat top 22 of cap 20 forms a semicircular recess 33 that has an inner surface that is adapted to receive loop portion 25 in snug relationship. Recess 33 is configured as semicircle having a flat bottom surface and is adapted to hold tab 24 with the top surface of the tab flush with flat top 22 of cap 20. Continuous wall 28 has an inner side surface defining the side of semicircular hole 26, and recess 33 has a semicircular inner side surface adapted to fit closely with the inner side surface of hole 26 when tab 24 is in its nonoperative position as shown in FIG. 1.

Hinge 30 as seen in FIG. 1 includes a narrow flexible strip 34 integral both with the middle of base wall 32 and with cap 20 located at the center of the base side of the semicircular inner side surface of recess 33. Strip 34 is readily movable between the nonoperative and operative positions. The nonoperative position is wherein tab 24 along with strip 34 is positioned in reces 33 along flat top 22, in particular flush with flat top 22 as shown in FIGS. 1 and 2. The operative position is wherein tab 24 along with strip 34 has been rotated away from top wall 22, in particular approximately perpendicular with top surface 22 as shown in FIGS. 1 and 2.

In operation, container 18 including cap 20 is packaged and shipped with tab 24 in the nonoperative position lying flat in recess 33 with the upper surface of the tab lying flush with the surface of flat top 22. When container 18 is prepared for display at display rack 12, tab 24 is rotated out of recess 33 at hinge 30, in particular at strip 34, to the operative position so that tab 24 can be placed onto the end 17 and then onto rod 17 by way of hole 26 and container 18 can be hung from display rack 12.

Another embodiment of the invention is illustrated in FIGS. 3 and 4 where a container 36 holding a liquid or high-pressure gas, for example, includes a relatively large cylindrical, snap-on cap 38 covering an applicator (not shown). Cap 38 has a diameter approximately the same as the diameter of container 36. Cap 38 has a circular, flat top 40 having a circular outer edge 40. Two flat tabs 42 and 43 integrally attached to flat top 40 are each diametrically positioned proximate to circular edge 41. Tabs 42 and 43 are shown in their nonoperative positions in FIG. 1 and in their operative positions in FIG. 2. In the nonoperative positions tabs 42 and 43 are positioned level with flat top 40; and in the operative positions tabs 42 and 43 are positioned approximately perpendicular to flat top 40. Tabs 42 and 43 include flat loop portions each having circular, narrow, continuous elements, or walls, 44 and 45, respectively, in turn defining circular holes 46 and 48, respectively. In the nonoperative position, tabs 42 and 43 are snugly positioned in circular recesses 50 and 52, respectively, which are formed by cap top 40 at diametrically opposed locations proximate circular edge 41. Tabs 42 and 43 include hinges 54 and 56, respectively, which are each located proximate circular edge 41. Hinges 54 and 56 are configured as flexible narrow hinges that integrally connect continuous walls 44 and 45 with cap 40 at the edges of recesses 50 and 52. When tabs 42 and 43 are rotated to their operative positions as shown in FIG. 2, circular holes 46 and 48 are in axial alignment when the tabs are in their operative positions. As shown in FIG. 2, containers 36 are hung from rod 16 which extends through holes 46 and 48 and supports tabs 42 and 43.

Another embodiment of the invention is shown in FIG. 5, which shows a plastic cap 60 having a flat top 62. A flat tab 64 is shown in frontal view in an operative position raised perpendicularly relative flat top 62 from its nonoperative position in a recess 66 formed at flat top 62. Tab 64 includes a continuous narrow element, or wall, 68 configured as a square that defines a square hole 70. Rod 16 is shown extending through hole 70 so as to support the container (not shown) to which cap 60 is snap-mounted. Tab 64 includes a hinge 72 integral with the center of one of the square elements of continuous square wall 68 and likewise integral with cap 60 at the center of one of the sides of recess 66, which is also square so as to accept square continuous wall 68 in snug relationship in the nonoperative position of the tab.

FIG. 6 shows another embodiment of the invention. A plastic cap 74 having a flat top 76 with a flat tab 78 rotatably connected to flat top 76 is snap-mounted to a container (not shown). Tab 78 includes a flexible hinge 80 which has been rotated so that tab 78 is positioned in an operative position perpendicular to flat top 76. Tab 78, which is shown in frontal view, includes a narrow continuous element, or wall, 82 configured as a triangle that defines a triangular hole 84 that is shown receiving rod 16 of the display rack. Triangular continuous wall 82 is adapted to be positioned in a triangular recess 86 formed at flat top 76 of cap 74. Hinge 80 is configured as a narrow strip integral with a triangular portion 88 of the side walls of continuous wall 82 and also integral with cap 74 at the middle of one of the side walls of triangular recess 86. Rod 16 is positioned at the flat side 90 opposite triangular portion 88 during the time the container is hung on the display rack.

The cylindrical snap-on caps hereinbefore described can be configured other than cylindrical in the spirit of the invention. In addition, the caps can be other than snap-on or snap-mounted; for example, they can be screw mounted.

It is to be noted that the flexible integral connection between the tabs and the cap is preferably accomplished by a molding process.

The embodiments and methods of the present invention particularly disclosed herein are presented merely as examples of the invention. Other embodiments, forms, modifications, and variations of the invention coming within the proper scope of the appended claims will, of course, readily suggest themselves to those skilled in the art.

What is claimed is:

1. A system adapted to hang a packaged product at a display rack having at least one horizontal mounting rod extend from the rack, said rod having a free end spaced from said rack, comprising, in combination:

a container, a plastic cap removably mounted on said container, said plastic cap having a flat top surface, said cap comprising, at least one flat tab of single layer plastic, said tab and cap being of unitary integral-mold type construction, said tab including a loop portion forming a hole capable of being received by said rod free end, and further including, a flexible plastic hinge integrally joining the tab with the cap, said tab being rotatably movable about said hinge between an operative position for being received by said rod, and a nonoperative position, wherein in said nonoperative position said tab is parallel with said cap top surface, and in said operative position said tab is positioned approximately perpendicular to said flat top surface, said cap flat top including a recess for receiving said flat tab when said tab is in the nonoperative position, there being no cap material above said hole in the nonoperative position, adding to stacking height, said loop portion including a continuous wall having an inner side surface defining said hole and having an outer side surface, and said recess having an inner side surface adapted to fit closely with said outer surface when said at least one tab is in said nonoperative position, said loop portion having a flat bottom side and said recess being further defined by a flat bottom surface, said flat bottom surface being continuous with said cap top, there being no opening by way of said recess through said cap top, said flat bottom side being positioned against said flat bottom surface when said tab is in said nonoperative position.

2. The system according to claim 1, wherein said hinge is a narrow strip connecting said continuous wall with said cap at said inner surface of said recess.

3. The system according to claim 2, wherein said cap is a relatively small cylindrical cap having a relatively small flat top, said flat top being generally circular, and said continuous wall is configured as a semicircle positioned generally at the center of said circular flat top with said hole being configured as a semicircle and said recess being configured as a semicircle, said continuous semicircular wall including a base wall, said strip being connected with the center of said base wall.

4. The system according to claim 2, wherein said cap is a relatively large cylindrical cap having a circular flat top, said at least one tab being two tabs diametrically spaced from one another, said two holes having two hinges including two of said narrow strips, said holes being aligned when said two tabs are in said operative position.

5. The system according to claim 4, wherein said circular flat top has a circular edge, said two strips each being proximate to said circular edge.

6. The system according to claim 5, wherein said continuous wall of each tab is configured as a circle with each said hole being configured as a circle and said recess being configured as a circle, said circular holes being in axial alignment when said tabs are in said operative position.

7. The system according to claim 2, wherein said continuous wall is configured as a square with said hole being configured as a square, said square wall having a base wall, said strip being connected with the center of said base wall.

8. The system according to claim 2, wherein said continuous wall is configured as a triangle with said hole being configured as a triangle and said recess being configured as a triangle, said continuous wall including a triangular portion and an opposed flat side, said strip being connected with said triangular portion, said rod being positioned at said flat side when said at least one tab is in said operative position.

9. The system according to claims 3 or 4, said cylindrical cap being a snap-on cap.

10. The system according to claims 3 or 4, said cylindrical cap being a screw-on cap.

* * * * *